US006585112B2

(12) United States Patent
Levin et al.

(10) Patent No.: US 6,585,112 B2
(45) **Date of Patent: *Jul. 1, 2003**

(54) CONTAINER FOR PERSONAL CARE PRODUCT

(76) Inventors: Adam A. Levin, 1830 N. Winchester, #317, Chicago, IL (US) 60622; Bradley S. Levin, 37073 Magnelia St., #205, Newark, CA (US) 94560

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/565,550

(22) Filed: May 5, 2000

(65) Prior Publication Data

US 2002/0108883 A1 Aug. 15, 2002

(51) Int. Cl.[7] ..... A45C 11/18

(52) U.S. Cl. ..... 206/39; 206/581; 206/823; 220/345.1

(58) Field of Search ..... 206/39, 39.1, 581, 206/823, 449; 150/147–149; 220/345.1, 345.2, 350

(56) References Cited

U.S. PATENT DOCUMENTS

| | | | | | |
|---|---|---|---|---|---|
| 1,631,334 | A | * | 6/1927 | Ovarnstrom | 206/39 |
| 1,658,496 | A | * | 2/1928 | Ovarnstrom | 206/39 |
| 4,535,890 | A | * | 8/1985 | Artusi | 206/530 |
| 4,660,295 | A | * | 4/1987 | Emrich | 206/39 |
| 4,898,195 | A | * | 2/1990 | Sussman | 132/317 |
| 5,010,673 | A | * | 4/1991 | Connor et al. | 40/661 |
| 5,163,457 | A | * | 11/1992 | Lombardi, Jr. | 132/304 |
| D341,738 | S | * | 11/1993 | Balanesi | 206/216 |
| 5,279,413 | A | * | 1/1994 | Wolfgang | 206/82 |
| 5,375,698 | A | * | 12/1994 | Ewart et al. | 206/5.1 |
| 5,548,483 | A | * | 8/1996 | Feldman | 361/737 |
| 5,592,767 | A | * | 1/1997 | Treske | 40/649 |
| D436,693 | S | * | 1/2001 | Thorpe et al. | D28/76 |

* cited by examiner

*Primary Examiner*—Shian Luong

(57) ABSTRACT

A container in a credit card format permitting the container to be carried in a wallet. The container comprises a base panel which can receive a face panel using an interlocking slide mechanism. The face panel has a shallow well which can hold a thin layer of lip gloss or other material.

6 Claims, 1 Drawing Sheet

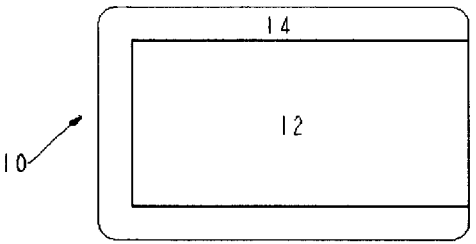
FIG. 1
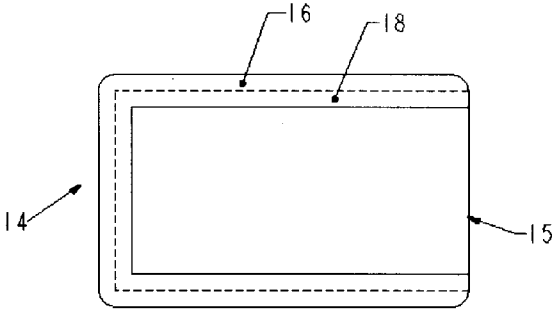
FIG. 2
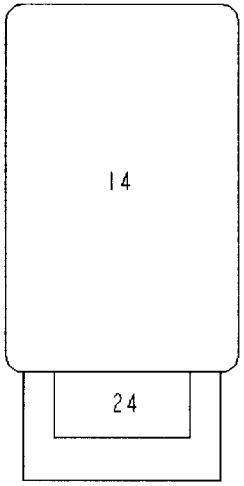
FIG. 3
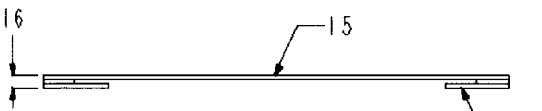
FIG. 4
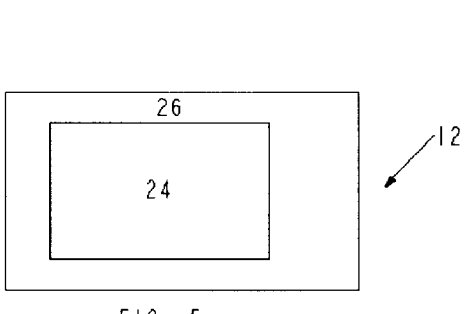
FIG. 5
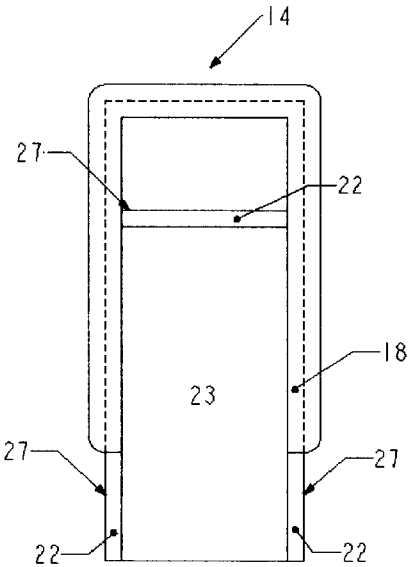
FIG. 6
FIG. 7

CONTAINER FOR PERSONAL CARE PRODUCT

FIELD OF THE INVENTION

This invention relates generally to containers for lip gloss or similar personal care products which are normally required in small quantities. It relates more particularly to a highly compact container, in a credit card format for lip gloss or the like.

BACKGROUND OF THE INVENTION

A personal care product such as lip gloss may be required with little notice. Since chapped lips may begin to occur with little warning and are best soothed with immediate application of lip gloss, it is important to have the lip gloss conveniently available at all times. Existing lip gloss containers are of shapes and sizes that are not conveniently carried on a daily basis on a person who does not have a purse or other carrying bag.

SUMMARY OF THE INVENTION

An object of this invention is to provide a container for lip gloss or the like which can be carried in a wallet or billfold.

Another object is to provide a container in credit card format, i.e., not much thicker than a standard credit card, yet large enough to contain a thin layer of lip gloss or the like.

Briefly stated, the invention comprises a base panel having a lip on three sides that can receive the face panel. The face panel has peripheral ridges on three sides that can nest under the lip within the face panel to form an interlocking, and sliding mechanism. The face panel contains a shallow well which holds lip gloss or the like.

BRIEF DESCRIPTION OF THE DRAWINGS

Following is a brief description of the drawings of the credit card sized container:

FIG. 1 is a plan view of the bottom of the container with the face panel inserted into the base panel;

FIG. 2 is a plan view of the bottom of the base panel with the face panel removed;

FIG. 3 is an end view of the bottom of the face panel;

FIG. 4 is an end view of the top of the base panel seen in FIG. 2;

FIG. 5 is a plan view of the top of the face panel;

FIG. 6 is a plan view of the bottom of the base panel, with the face panel slid partly out of the base panel; and FIG. 7 is a plan view of the top of the base panel, with the face panel slid partly out to reveal its well.

DESCRIPTION OF THE PREFERRED EMBODIMENT

Referring now to FIG. 1, there is shown a container 10 embodying features of the invention. This is a plan view of the bottom of the container with a face panel 12 inserted into a base panel 14. Both panels 12 and 14 are preferably fabricated of recyclable, flexible synthetic plastic material such as polyvinyl chloride or other thermoplastic material. Typical credit card dimensions are preferred for the length and width of the container 10, such as 3 and ¼ inches by 2 and ⅛ inches.

FIG. 2 is a plan view of the bottom of the base panel 14 alone. The panel 14 includes a thin bottom 15 and three short, upstanding side walls 16 extending along two sides and one end of the base panel 14. Each short side wall 16 has an overhanging inner ledge 18. The side walls 16 and ledges 18 are shown in FIG. 4. The thickness of the panel 14 at the sidewalls 16 is approximately the thickness of two credit cards.

FIG. 3 is an end view of the face panel 12 and FIG. 5 is a top plan view. The face panel 20 has an upper face 21 and a lower face 23. The lower face 23 has a recess 22 formed in it along each of its two side edges and one end edge.

FIG. 5 shows the shallow well 24 which is formed in the top of the face panel and in which lip gloss or other material is stored. The thickness of the face panel 12 is the same as the thickness of the base panel's short side walls 16. The depth of the well 24 is the thickness of one credit card.

FIG. 6 is a plan view of the bottom of the container 10, with the face panel 12 slid partly out of the base panel 14 to reveal the interlocking and nested nature of the container. There it will be seen that the recess 22 formed around two sides and one end of the lower face 23 on the face panel 20 creates thinner, outer edges 27 around three sides of the panel. As the face panel 12 is inserted into the base panel 14, the outer edges 27 slide under corresponding inner ledges 18 in the base panel.

FIG. 7 is a plan view looking down on the top of the base panel 14 with the face panel 12 slid partly out to reveal the well 24. To access the material stored in the well 24 of the face panel 12, one simply slides the face panel out of the base panel. The base panel is preferably of opaque plastic material which may be printed or embossed on its top surface (seen in FIG. 7) to carry identification, advertising, or promotional material.

We claim:

1. A container, comprising:

a) a base panel formed of thin plastic sheet material, said base panel including a thin bottom and three short, upstanding walls extending along two sides and one end of said base panel, said walls extending along said two sides each having an inwardly extending ledge; and b) a face panel formed of thin plastic sheet material and having a top and a bottom and opposite side edges, said bottom of said face panel having a recess adjacent each side forming a thinner panel edge which is adapted to slide under a corresponding ledge of said base panel when said base panel and said face panel are assembled, said top of said face panel having a well formed therein for receiving and storing product;

c) said container being closed by sliding said face panel fully into said base panel from the end of said base panel opposite said one end and opened by sliding said face panel at least partially out of said base panel to expose said well, both of said panels being flexible so that said closed container is flexible.

2. The container of claim 1 further characterized in that:

a) an inwardly extending ledge is also formed in said one end wall; and b) a thinner panel edge is also formed on one end of said face panel;

c) said thinner panel edge on said one end of said face panel sliding under said inwardly extending ledge in said one end wall when said container is closed.

3. The container of claim 1 further characterized in that:

a) said well has a depth approximately that of a conventional plastic credit card.

4. The container of claim 1 further characterized in that:

a) said base panel and said face panel each being rectangular.

5. The container of claim 4 further characterized in that:

a) said face panel has a thickness of approximately two conventional plastic credit cards or 1/16 of an inch;

b) said well having a depth of approximately one conventional plastic credit card or 1/32 of an inch.

6. A container, comprising:

a) a base panel formed of thin plastic sheet material, said base panel including a thin bottom and three short, upstanding walls extending along two sides and one end of said base panel, said walls extending along said two sides each having an inwardly extending ledge; and b) a face panel formed of thin plastic sheet material and having a top and a bottom and opposite side edges, said bottom of said face panel having a recess adjacent each side forming a thinner panel edge which is adapted to slide under a corresponding ledge of said base panel when said base panel and said face panel are assembled; and c) a well between said base panel and said face panel for receiving and storing said product;

d) said container being closed by sliding said face panel fully into said base panel from the end of said base panel opposite said one end and opened by sliding said face panel at least partially out of said base panel to expose said well, both of said panels being flexible so that said closed container is flexible.

* * * * *